United States Patent [19]

Gotzmer, Jr.

[11] 3,981,756

[45] Sept. 21, 1976

[54] PROCESS FOR PREPARING HIGH DENSITY SOLID PROPELLANTS

[75] Inventor: Carl Gotzmer, Jr., La Plata, Md.

[73] Assignee: The United States of America as represented by the Secretary of the Navy, Washington, D.C.

[22] Filed: Sept. 9, 1975

[21] Appl. No.: 611,772

[52] U.S. Cl. ..... 149/19.3; 149/19.92; 149/20; 149/109.2; 149/119

[51] Int. Cl.[2] ..... C06B 45/10; C06B 21/00

[58] Field of Search ..... 149/19.3, 19.92, 109.2, 149/119, 20

[56] References Cited

UNITED STATES PATENTS

| | | | |
|---|---|---|---|
| 3,041,216 | 6/1962 | Bice | 149/19.92 X |
| 3,520,742 | 7/1970 | Witz | 149/19.3 X |
| 3,669,020 | 6/1972 | Waite et al. | 149/19.3 |
| 3,732,132 | 5/1973 | Merrow et al. | 149/19.3 |
| 3,753,811 | 8/1973 | Julian et al. | 149/19.3 |
| 3,797,238 | 3/1974 | Iwanciow et al. | 149/19.3 X |
| 3,853,645 | 12/1974 | Kaufman et al. | 149/19.3 |

OTHER PUBLICATIONS

Christe et al., *Inorganic Chemistry*, 12, 2478–2481 (1973).

Goetschel et al., *Inorganic Chemistry*, 11, 1696–1701 (1972).

*Primary Examiner*—Edward A. Miller

*Attorney, Agent, or Firm*—R. S. Sciascia; A. L. Branning; P. J. Hagan

[57] ABSTRACT

High density solid propellants are prepared by a process which comprises mixing the solid propellant components comprising a perfluorinated polymer, such as high molecular weight polytetrafluorethylene, and an inorganic oxidizer salt, such as $NF_4BF_4$, with a dispersion containing a dissolved low molecular weight perfluorinated polymer, a suspended low molecular weight pefluorinated polymer and a suitable solvent, removing the solvent from the mixture, and drying the solids.

12 Claims, No Drawings

PROCESS FOR PREPARING HIGH DENSITY SOLID PROPELLANTS

BACKGROUND OF THE INVENTION

The present invention relates to a process for preparing high density solid propellants. More particularly, the present invention relates to a process for preparing high density solid propellants in which hydrogen sensitive salts are employed as the oxidizer. The present invention is particularly useful for the preparation of a solid propellant comprising $NF_4BF_4$, high molecular weight polytetrafluorethylene and low molecular weight polytetrafluoroethylene, said propellant having utility as a gas generator for chemical lasers.

High density propellants are typically composed of a fluorocarbon binder, a metal fuel and an inorganic oxidizer salt. Various additives and modifiers well known to those skilled in the propellant art may also be included in the propellant composition. Specific examples of high density solid propellant compositions are set forth in U.S. Pat. Nos. 3,513,043 and 3,876,477.

In general, high density solid propellants are prepared by first dissolving Viton-A, a copolymer of vinylidene fluoride and hexafluoropropylene, in a suitable solvent such as acetone, or another low boiling ketone. Next, the solid ingredients of the composition, namely, polytetrafluoroethylene, metal fuel, oxidizer salt and modifiers, if any, are thoroughly mixed into the Viton-A solution to form a uniform slurry or suspension. Next, a non-solvent for the Viton-A, such as hexane, is added to the suspension. As a result of the addition of the non-solvent the Viton-A precipitates onto the solid ingredients in the slurry. After the suspension settles, the supernatant liquid is decanted and the resulting residue is dried. Once dry, the coated solid propellant ingredients may be subjected to further processing such as extrusion or molding to form propellant grains. The process just described is commonly referred to as the shock-gel or shock-precipitation method for preparing high density composite propellants.

Attempts to prepare high density solid propellants containing hydrogen sensitive oxidizers, such as $NF_4^+$ salts, according to the shock-precipitation method described above have failed because Viton-A and the processing solvents used therein, are incompatible with $NF_4^+$ salts.

Experiments have been conducted in an effort to prepare propellants containing hydrogen sensitive oxidizer salts by the cast system in which functionally terminated polymers are reacted with a crosslinking agent to provide a strong binder material. However, it was discovered that oxidizers such as $NF_4^+$ salts attack all types of hydrogen containing polymeric binders as well as nitroso type binders and binders containing functional groups such as hydroxyl groups, amino groups, and isocyanato groups. In view of this marked incompatibility with such a vast number of organic materials the cast system of curing binders by the use of functionally terminated polymers and crosslinking agents is not suited to the preparation of propellants containing hydrogen sensitive oxidizers, such as $NF_4^+$ salts.

One method presently being used to prepare propellants containing hydrogen sensitive oxidizers involves mixing the powdered oxidizer salt with powdered polytetrafluoroethylene and pressing the dry mixture into grains in the solid state. However, the propellant grain produced by pressing the mixture of dry components has been found to be unsatisfactory with respect to its homogeneity, grain integrity, and burning rate.

Thus, a need exists for a process for preparing high density solid propellants containing hydrogen sensitive materials which produces propellant grains having superior homogeneity, improved mechanical properties and a more even burning rate as compared to processes presently employed in the art.

SUMMARY OF THE INVENTION

It is therefore an object of the present invention to provide an improved process for preparing high density solid propellants.

Another object of the present invention is to provide a process for preparing high density solid propellants containing a hydrogen sensitive oxidizer salt.

It is a further object of the present invention to provide a process for preparing a high density solid propellants containing a hydrogen sensitive oxidizer salt, said propellants having improved mechanical properties.

Yet another object of the present invention is to provide a process for preparing high density solid propellants containing a hydrogen sensitive oxidizer salt, said propellants having improved homogeneity.

A further object of the present invention is to provide a process for preparing high density solid propellants containing a hydrogen sensitive oxidizer salt, said propellants having an improved burning rate.

It is also an object of the present invention to provide a new solid propellant gas generator for chemical lasers.

DESCRIPTION OF THE PREFERRED EMBODIMENTS

According to the present invention there is provided a process for preparing a high density solid propellant which comprises mixing the solid propellant components, namely, a perfluorinated polymer, and an inorganic oxidizer salt with a dispersion containing a dissolved low molecular weight perfluorinated polymer, a suspended low molecular weight perfluorinated polymer and a suitable solvent; removing the solvent from the mixture; and drying the solids. The dried solids can be consolidated in the form of a grain, for example, by extrusion, molding, or the like.

A finely divided metal fuel may be added to the propellant components mentioned above in order to form a high density composite propellant. The metal fuels which may be employed in the instant process include aluminum, magnesium, zirconium, uranium thorium, beryllium and mixtures thereof.

The inorganic oxidizer salts which may be employed in the instant process include the ammonium, alkali metal, and alkaline earth metals of nitric, perchloric, and chloric acids, and mixtures thereof. Representative inorganic oxidizing salts include sodium, potassium, magnesium, and ammonium perchlorates, lithium and strontium chlorates, and potassium, sodium, calcium and ammonium nitrates.

The present invention is particularly useful in the preparation of high density solid propellents containing hydrogen sensitive oxidizer salts. A typical type of hydrogen sensitive oxidizer salt is one containing the $NF_4^+$ cation. Specific examples of $NF_4^+$ salts include $NF_4BF_4$, $NF_4AsF_6$, and $NF_4SbF_6$.

The perfluorinated polymers which may be employed as binders in the instant process include fluorocarbon polymers, perfluoropolyesters, perfluorosilicones and perfluoropolyethers. The preferred perfluorinated polymer binders are fluorocarbon polymers, such as polytetrafluoroethylene, polychlotrifluoroethylene, or polyhexafluoropropylene.

The perfluorinated polymer making up one of the solid propellant ingredients is preferably a high molecular weight polytetrafluoroethylene (PTFE). A suitable high molecular weight PTFE is Teflon, sold by E.I. duPont de Nemours & Co. The Teflon preferred for use in the present invention has an average particle size of 30 microns and an average molecular weight of 2 to 3 million.

The perfluorinated polymer which is both dissolved and suspended in the dispersion utilized in the process is preferably a low molecular weight PTFE. A suitable low molecular weight PTFE is Vydax, sold by E.I. duPont de Nemours & Co. The Vydax preferred for use in the present invention has an average molecular weight of 3700, 60% of the particles being less than 5 microns and 100% of the particles being less than 30 microns.

The term "suitable solvent" is intended to signify a liquid fluorocarbon as that term is defined in the Condensed Chemical Dictionary, 8th edition, page 396, (1971). Suitable solvents include Freon. Freon is a trademark for a series of nonflammable, nonexplosive, noneorrosive and essentially stable and inert liquid fluorocarbons sold by E.I. duPont de Nemours & Co. Other suitable solvents include 1,1,1-trichloropentafluoropropane, perfluorocyclohexane, 1,1,1,3-tetrachloroterta-fluoropropane, and 1,2-dichlorohexafluorocyclobutane. The preferred solvent for use in the present invention is 1,1,2-trichlorotrifluoroethane.

A dispersion of low molecular weight PTFE which is partially dissolved and partially suspended in 1,1,2-trichlorotrifluoroethane is commercially available under the name Vydax 5100 from E.I. duPont de Nemours & Co.

When a high density solid propellant in which the oxidizer salt is not hydrogen sensitive is prepared according to the present invention any suitable hydrogen containing solvent may be used.

Generally, the essential components of the high density solid propellants will be present in the relative amounts set forth in Table I.

TABLE I

| Component: | Weight | | Percent |
|---|---|---|---|
| Inorganic oxidizer salt | 25 | to | 70 |
| High molecular weight fluorocarbon polymer | 5 | to | 50 |
| Low molecular weight fluorocarbon polymer | 10 | to | 25 |
| Metal Fuel | 0 | to | 35 |

When the instant process is utilized to prepare a solid propellant gas generator for chemical lasers, such as the one described below, the binder material, i.e. the high and low molecular weight fluorocarbons may be present in the range from about 5% to about 95% based on the total weight of the propellant.

The invention is illustrated by the following example which shows the preparation of a high density solid propellant containing a hydrogen sensitive oxidizer.

EXAMPLE $NF_4BF_4$ and teflon (30 $\mu$ particles of 2-3 million M.W. PTFE) were mixed under dry nitrogen with a dispersion containing dissolved low molecular weight PTFE (soluble low fraction 3700 M.W. PTFE), suspended low molecular weight PTFE (high fraction 5 $\mu$ particles of 3700 M.W. PTFE) and 1,1,2-triclorotrifluoroethane as the solvent. The solvent was removed in a vacuum bell after mixing and the solids dried and pressed or extruded into propellant grains. During removal of the solvent, the solid ingredients of the propellant became coated with the low molecular weight PTFE that was originally dissolved.

When hydrogen sensitive oxidizers are used, as in the above example it is necessary to carry out the process with non-hydrogen containing solvents in a moisture free atmosphere.

In order to show the improvement in mechanical properties of the propellant grains prepared according to the present invention as compared to the method presently being used to prepare propellant grains containing hydrogen sensitive oxidizers the following inert test grains were prepared.

Three inert grains were produced substituting NaF for $NF_4$ $BF_4$. The grains (2 g each) consisted of 70% NaF and 30% Teflon 7-C and were prepared by mixing 1.4 g of dry NaF and 0.6g of Teflon 7-C. Three independent mixes were made (one each, designated 1A, 1B, 1C) for pressing at 27,000 psi.

Three inert grains (2g each) consisting of 70% NaF, 15% Teflon 7-C and 15% Vydax 78U (PTFE MW 3700) were prepared by mixing 3 ml of Vydax 5100 (10% Vydax 78U suspended in 1,1,2-trichlorotrifluoroethane) with 1.4 g of NaF and 0.3 g of Teflon 7-C. The mixture was evaporated to dryness in a vacuum bell and pressed at 27,000 psi. Three independent mixes were made and designated 2A, 2B, and 2C.

Three inert grains were produced (2g each) consisting of 70% NaF, 15% Teflon 7-C and 15% Vydax 78U (MW 3700), which were prepared by dry mixing of 1.4g NaF, 0.3g Teflon 7-C and 0.3g Vydax 78U. The grains were designated 3A, 3B and 3C.

Three inert grains (2 g each) consisting of 70% NaF, 15% Teflon 7-C and 15% Vydax 1000 (PTFE, MW 25,000) prepared by mixing 4 ml of Vydax 1000 Fluorotelomer Dispersion (7.5% Vydax 1000 suspended in 1,1,2-trichlorotrifluoroethane) with 1.4g of NaF and 0.3 g of Teflon 7-C. The mixture was evaporated to dryness in a vacuum bell and pressed at 27,000 psi. Three independent mixes were made and designated 4A, 4B, and 4C.

The above described inert grains were tested on an Instron Universal Testing Machine TTC-Ml in order to determine the longitudinal crush strength, compression strain, compression modulus and compression work. The conditions for testing were; 77°F, crosshead rate 0.1 in/min, chart speed 2 in/min and a load scale of 500 lbs. The final mechanical parameters were determined by averaging of three separate tests. The results are shown in Table III.

TABLE II

| | Run No. 1 | Run No. 2 | Run No. 3 | Run No. 4 |
|---|---|---|---|---|
| $\sigma f$ (psi) | 2659 | 3539 | 3190 | 3020 |
| $\epsilon f$ (psi) | 3.1 | 4.1 | 3.1 | 3.2 |
| E (psi) | 86,331 | 86,738 | 102,656 | 95,866 |
| W in-lb/in$^3$ | 40.9 | 72.2 | 49.6 | 47.2 |

The data indicates that binding methods employing high and low molecular weight Vydax applied with solvent produce grains in mechanical integrity superior to that obtained from dry Teflon methods (Run No. 1 ). Moreover, Vydax 78U yields better mechanical property values than plain Teflon if mixed dry.

The high molecular weight Vydax produced grains of lesser quality than with Vydax of low molecular weight. The difference is thought to arise from the fact that the low molecular weight Vydax is particularly soluble in the solvent producing a better coating on the solids when subjected to drying.

In order to show the storage stability of the propellant grains prepared according to the present invention the following test was performed.

Two grains were produced substituting NaF for $NF_4BF_4$. The grains were made identically to the grains listed in Table II under Run No. 2. The two grains were aged two months in high humidity environment and designated 5A and 5B. The mechanical property values obtained from grains 2 and 5 are listed in Table III and indicate very little degradation taking place from absorbed moisture. The salt particles are apparently very well coated with the binder.

TABLE III

| | Run No. 2 | Run No. 5 |
|---|---|---|
| $\sigma f$ (psi) | 3539 | 3416 |
| $\epsilon f$ (psi) | 4.1 | 4.2 |
| E (psi) | 86,738 | 81,529 |
| W in-lb/in$^3$ | 72.2 | 71.5 |

The present invention can be used in the preparation of high density composite propellants as a substitute for the shock-precipitation method involving the use of Viton-A and various processing solvents. The elimination of the use of hydrogen containing Viton-A will result in the preparation of propellant grains having even higher densities than those produced by the standard shock-precipitation method. Moreover, since the present invention involves only the removal of a single solvent by a drying operation as opposed to dissolving and precipitating operations involving the use, separation and recovery of several processing solvents, it is attractive from an economic standpoint.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A process for preparing a high density solid propellant which comprises mixing the solid propellant components which comprise a high molecular weight perfluorinated polymer binder and an inorganic oxidizer salt with a dispersion comprising a dissolved low molecular weight perfluorinated polymer, a suspended low molecular weight perfluorinated polymer and a suitable solvent; removing the solvent; and drying the resulting solids.

2. The process of claim 1 wherein the solid propellant components additionally comprise a metal fuel.

3. The process of claim 1 wherein the inorganic oxidizer salt is hydrogen sensitive.

4. The process of claim 3 wherein the solvent is a liquid fluorocarbon.

5. The process of claim 4 wherein the removal of the solvent is accomplished by evaporation under reduced pressure.

6. The process of claim 4 wherein the inorganic oxidizer salt is selected from the group consisting of $NF_4BF_4$, $NF_4AsF_6$, $NF_4SbF_6$ and mixtures thereof.

7. The process of claim 6 wherein the perfluorinated polymer binder is a high molecular weight polytetrafluoroethylene, the inorganic oxidizer salt is $NF_4BF_4$, the dissolved and suspended low molecular weight perfluorinated polymer is polytetrafluoroethylene and the solvent is 1,1,2-trichlorotrifluoroethane.

8. The process of claim 7 wherein the high molecular weight polytetrafluoroethylene has an average molecular weight of about 3 million, and the low molecular weight polytetrafluoroethylene has an average molecular weight of about 3700.

9. The process of claim 8 which additionally comprises pressing the dry solids into a propellant grain.

10. The process of claim 8 wherein the high molecular weight polytetrafluoroethylene has an average particle size of 30 microns and the low molecular weight polytetrafluoroethylene has a particle size such that 60% of the particles are less than 5 microns and 100% of the particles are less than 30 microns.

11. The product of the process of claim 5.

12. A high density solid propellant consisting essentially of 25 to 70% of $NF_4BF_4$, 5 to 50% of a polytetrafluoroethylene having an average molecular weight of about 3 million and 10 to 25 percent of a polytetrafluoroethylene having an average molecular weight of about 3700.

* * * * *